US005320178A

United States Patent [19]

Cornette

[11] Patent Number: 5,320,178

[45] Date of Patent: Jun. 14, 1994

[54] SAND CONTROL SCREEN AND INSTALLATION METHOD FOR WELLS

[75] Inventor: H. Mitchell Cornette, Houston, Tex.

[73] Assignee: Atlantic Richfield Company, Los Angeles, Calif.

[21] Appl. No.: 987,934

[22] Filed: Dec. 8, 1992

[51] Int. Cl.[5] ..... E21B 7/00

[52] U.S. Cl. ..... 175/19; 166/278; 175/65

[58] Field of Search ..... 166/278, 51; 175/19, 175/65

[56] References Cited

U.S. PATENT DOCUMENTS

| | | | |
|---|---|---|---|
| 4,995,456 | 2/1991 | Cornette et al. | 166/51 |
| 5,145,004 | 9/1992 | Cornette | 166/278 |
| 5,253,708 | 10/1993 | Alexander | 166/278 |
| 5,261,486 | 11/1993 | Cornette et al. | 166/51 |

*Primary Examiner*—Thuy M. Bui
*Attorney, Agent, or Firm*—Michael E. Martin

[57] ABSTRACT

A sand control screen is installed in a well by interposing the screen in a drillstring having a retrievable bit and drive motor. The screen is drilled into place with the distal end of the drillstring and remains in the wellbore. The drillstring may be disconnected from a bottom hole assembly comprising the screen and the distal end of the drillstring and replaced by a tubing string having a packer or other external seal member interposed therein for sealing one portion of the wellbore from another. The sand control screen has a basepipe with plural apertures temporarily closed plugs which are threadedly or force-fit in the apertures. The plugs may be formed of a meltable or dissolvable fiber reinforced wax, for example, or an active metal which may be dissolved by an acid or caustic solution. The screen may also include a temporary plugging medium such as wax in the interstices of the screen sleeve to prevent accumulation of drilling fluid solids during insertion in the wellbore.

9 Claims, 3 Drawing Sheets

SAND CONTROL SCREEN AND INSTALLATION METHOD FOR WELLS

BACKGROUND OF THE INVENTION

1. Field of the Invention

The present invention pertains to a sand control screen and installation method particularly adapted for open-hole and deviated or generally horizontally-extending wellbores.

2. Background

The use of so-called gravel pack or sand control screens is common practice in oil well completions. The installation of these screens in many applications is a delicate and troublesome exercise because of the tendency for the screen to become prematurely plugged with solids present in the well fluids and, in the case of so-called open-hole completions, the potential for collapse of the wellbore.

The problems associated with sand control screen installations are aggravated with the recent trend to drilling deviated and generally horizontal wells. These wells, in particular, are often completed without the installation of a casing or other formation support structure to improve well production and reduce cost of the well and due to the problems associated with installation of such structures. Conventional practice in drilling generally horizontal or deviated wells involves drilling the well to the desired length or "depth" followed by removal of the drillstring and the running in of a so-called completion string. During the removal and reinstallation of these pipe strings, there is a risk that the formation may collapse into the wellbore and reliance is usually placed on hydraulic pressure and the accumulation of so-called mud cake on the wellbore walls to prevent the "hole" from collapsing. Accordingly, there is significant risk of the wellbore collapsing, thereby requiring redrilling or abandonment of the well.

One solution to the above-mentioned problem is to drill the well with the sand control screen in place as part of the lower end of the drillstring. However, this type of operation requires leaving the drillbit in the wellbore or providing a drillstring with a retrievable bit or bit and motor assembly such as that described in U.S. patent application Ser. No. 07/744,859, filed Aug. 14, 1991 by Richard E. Leturno and assigned to the assignee of the present invention. The placement of a sand control screen in the drillstring and making the lower end of the drillstring a permanent part of the well completion assembly is attractive. However, the above-mentioned arrangement still presents certain problems in avoiding premature plugging of the sand control screen with solids and completing the production string assembly. The present invention overcomes some of these problems as will be further described herein.

SUMMARY OF THE INVENTION

The present invention provides an improved sand control screen installation for fluid-producing wells, and particularly for open-hole and generally horizontal or deviated wellbores.

In accordance with one aspect of the present invention, a method for installing a sand control screen in a fluid-producing well is carried out by placing the sand control screen in the drillstring and leaving the distal end of the drillstring and the sand control screen in the wellbore upon completion of the drilling process.

In accordance with another aspect of the present invention, an improved sand control screen is provided which reduces the chance of plugging the screen with particulate solids during the installation procedure. In this regard, the sand control screen is provided with dissolvable plugs in the screen basepipe ports, which plugs are formed of an active metal or other materials which may be easily dissolved once the screen has been put in place in the wellbore and preparation for completion of the well is carried out. The sand control screen may also be provided with a dissolvable or fusible material which is impregnated in the screen sleeve around the basepipe so that this material may also be removed when desired to prevent premature plugging of the screen with particulate solids during installation of the screen.

In accordance with yet another aspect of the present invention, a unique sand control screen installation is provided which is particularly adapted for open-hole well completions and including deviated or so-called horizontally-extending completions. Advantages of the present invention include those mentioned above wherein premature plugging of the screen is reduced or eliminated, the step of installing the screen after completion of drilling operations is substantially eliminated in that the screen is placed in the distal end of the drillstring and this structure is left in the wellbore upon completion of drilling operations. Accordingly, the chance of collapsing of the well in unconsolidated sands and horizontal wellbores is substantially reduced or eliminated. Moreover, by installing the screen while drilling the well minimal loss of completion fluids is realized. This is an important consideration when using expensive weighted brines, for example, as completion fluids. Other advantages of the present invention include the elimination of the requirement to build a substantial layer of mud "filter cake" on the wellbore wall and the consequent loss of fluids to the earth formation around the well.

The above-mentioned advantages and features of the invention, together with other superior aspects thereof, will be further appreciated by those skilled in the art upon reading the detailed description which follows in conjunction with the drawing.

DESCRIPTION OF PREFERRED EMBODIMENTS

Figure 1:
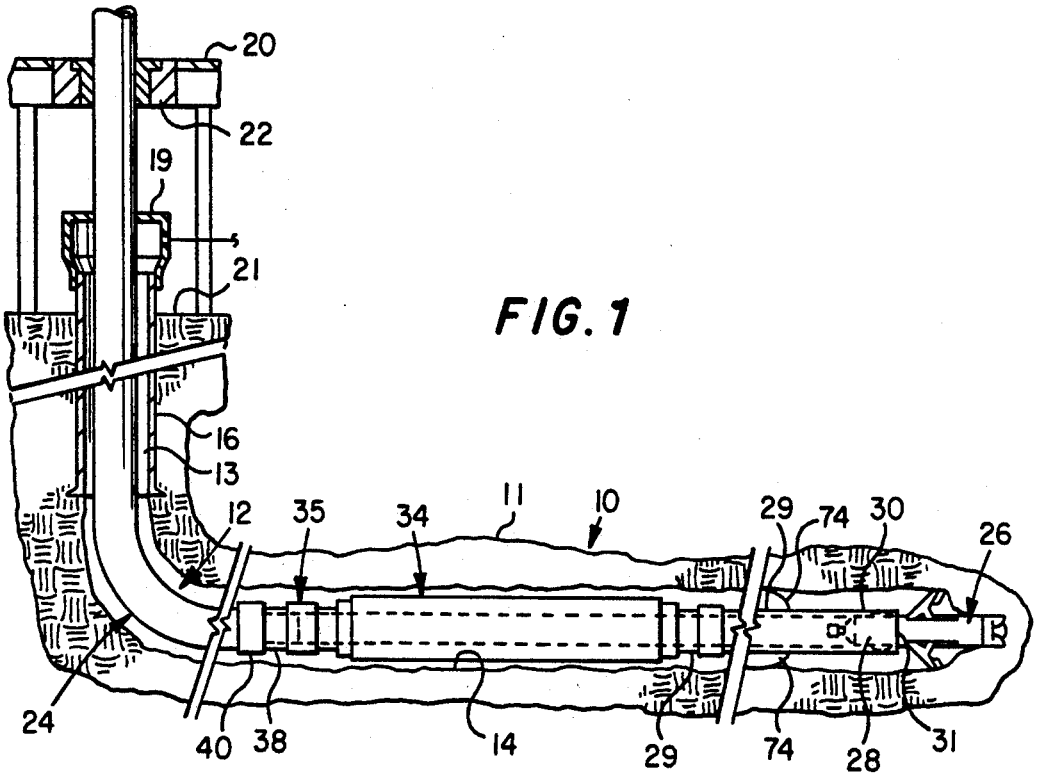
FIG. 1 is a side view in somewhat schematic form of a generally horizontal well being drilled with the sand control screen and associated structure of the present invention.

In the description which follows, like parts are marked throughout the specification and drawing with the same reference numerals, respectively. The drawing figures are generally not to scale and are shown in somewhat simplified and schematic form in the interest of clarity and conciseness.

Referring to FIG. 1, there is illustrated a portion of an earth formation 10 into which a wellbore 12 is being drilled including a generally horizontally-extending portion 14. The transition from the vertically-extending portion 13 of the wellbore 12 to the horizontally-extending portion 14 is exaggerated in the interest of clarity. At least the vertically-extending wellbore portion 13 is provided with a suitable casing 16 whereas the formation zone of interest has been penetrated by the generally horizontally-extending portion 14 which is uncased or in a "open-hole condition". The casing 16 is provided with a suitable bell nipple 19 and a drilling rig, generally designated by the numeral 20, is illustrated in part disposed at the surface 21, and including a conventional rotary table 22.

An elongated cylindrical pipe drillstring 24 extends from the drill rig 20 through the wellbore 12 and includes at its distal end a retrievable bit assembly 26. The retrievable bit assembly 26 may be of the type described in U.S. patent application Ser. No. 07/744,859 by Richard E. Leturno which is incorporated herein by reference. The bit assembly 26 may be connected to a suitable drive motor 28, also of the type described in the above-referenced patent application. The bit and motor assembly 26, 28 may be retrieved through the interior of the drillstring 24 when drilling operations are complete. The drillstring 24 may also be of a type which is rotated to effect rotation and cutting action of the bit 26 from the surface by operation of the rotary table 22. Conversely, and particularly in the instance of drilling generally horizontal wells, the drillstring 24 is preferably of the non-rotatable type wherein the hydraulic motor 28, which is driven by drilling fluid, is operable to rotate the bit 26 while the drillstring remains non-rotatable in the wellbore 12. The motor 28 and the bit assembly 26 are latched into a suitable landing nipple or sub 30 at the distal end 31 of the drillstring which may include a suitable recess or recesses for receiving suitable locking members associated with the motor 28 or a support member for the bit assembly 26 so that the motor and bit assembly may be retrieved through the interior of the drillstring by a suitable retrieval mechanism, not shown. In the instance of retrieval from a horizontal well, such retrieval mechanism would likely be connected to the distal end of a coilable tubing string, also not shown. Insertion and retrieval of the bit assembly 26 and the motor 28 may be carried out generally in accordance with the method described in the referenced patent application and is not believed to require further detailed description herein.

The drillstring 24 advantageously includes a sand control screen 34 interposed therein and connected to a tailpipe section 29 which includes the landing nipple 30. The screen 34 is in a position such that it will be disposed in the wellbore portion 14 adjacent the zone of interest 11 for controlling the flow of sand with fluids to be produced from the formation 11 to minimize entrainment of such material in the fluid to be produced from the well 12. The sand control screen 34 is of unique configuration which will be described in further detail herein.

Up-hole from the sand control screen 34 in the drillstring 12, there is interposed a hook-up nipple assembly 38 which is of conventional construction and of a type, for example, which is commercially available from Baker Sand Control division of Baker Hughes Incorporated, Houston, Tex. Basically, the hook-up nipple 38 is operable to provide for disconnecting the portion of the drillstring 24 between the hook-up nipple 38 and the drill rig 20. A suitable running tool or coupling portion 40, also commercially available from Baker Sand Control, is connected to the drillstring 24, where indicated, for connection to and decoupling from a "bottom hole assembly" 35 which includes the hook-up nipple 38 and the portion of the drillstring, including the sand control screen 34, and the tailpipe section 29 which is to remain disposed in the well 12.

One problem associated with installing sand control screens is the premature plugging of the screen by drilling fluid and other wellbore fluids that have particulate solids entrained therewith. Several efforts have been made to alleviate this problem including impregnating the screen outer sleeve with a meltable or fusible material such as paraffin wax. An improved sand control screen and method which alleviates certain problems in installing sand control screens is described in U.S. patent application Ser. No. 07/921,185, filed Jul. 28, 1992, to H. Mitchell Cornette and Steven E. Morrison and assigned to the assignee of the present invention.

Figure 2:
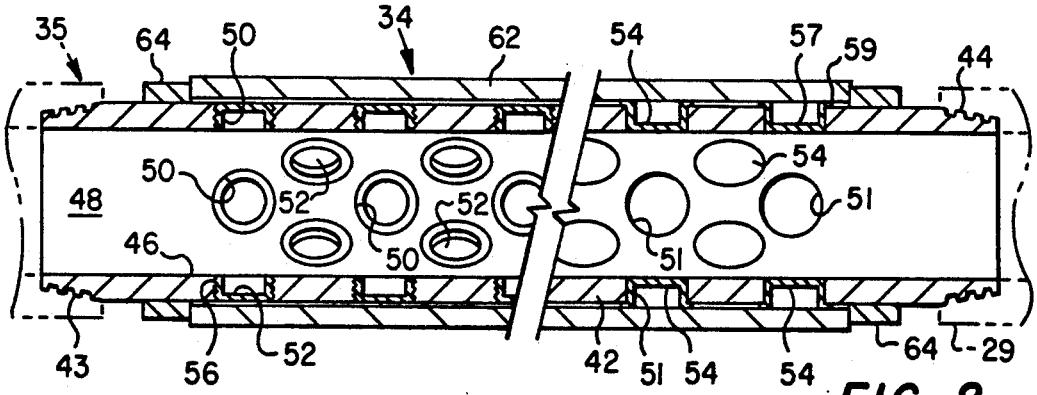
FIG. 2 is a detail longitudinal central section view of an improved sand control screen in accordance with the present invention.
Figure 3:
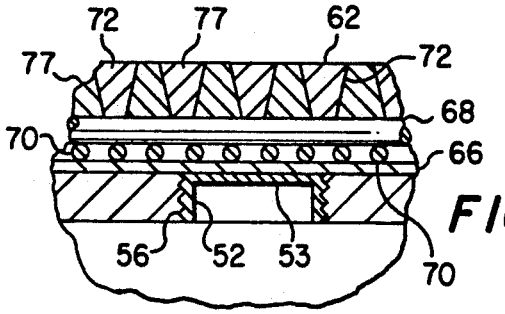
FIG. 3 is a detail section view of a portion of the screen illustrated in FIG. 2.

The improved sand control screen 34 is further illustrated in FIGS. 2 and 3. Referring to FIG. 2, the screen 34 includes a cylindrical basepipe member 42 which is suitably configured at opposite ends to permit connection of the screen to the drillstring 24. External threaded portions 43 and 44 are illustrated. The basepipe 42 has a smooth, cylindrical bore 46 defining a flow passage 48 which is of sufficient diameter to permit insertion and retrieval operations for the bit 26 and motor 28 as well as other devices to be described herein. The basepipe 42 is provided with a relatively large number of flow ports or apertures 50 and 51 which are arranged around the circumference of the basepipe and in a predetermined pattern. In accordance with the teaching of U.S. patent application Ser. No. 07/952,558, filed Sept. 28, 1992, entitled "Foil Wrapped Basepipe for Sand Control" in the name of Bryant Alan Arterbury and H. Mitchell Cornette, it is desirable, under certain operating conditions, to prevent fluid flow through the apertures 50 during installation of the sand control screen but, later on, to open these apertures so that fluid may flow therethrough between the wellbore 14 and the passage 48.

In accordance with the present invention, the apertures 50 and 51 are temporarily closed by sacrificial plugs 52 and 54, respectively. The plugs 52 are provided with external threads 56, see FIG. 3 also, which are threadedly engaged with cooperating internal threads formed on the basepipe 42 in each of the apertures 50 as indicated in FIGS. 2 and 3. Others of the apertures, such as the apertures 51 also as indicated in FIG. 2, may be formed by a smooth bore and the plugs 54 are characterized by somewhat cup-shaped members having a relatively thin transverse bottom wall 57 and a circumferential collar 59. The plugs 54 are press- or "interference"-fitted into the apertures 51. The plugs 52 and 54 are also provided with a relatively thin transverse bottom wall 53 to minimize the amount of sacrificial material that must be dissolved as these plugs are removed in accordance with the present invention. Still further, the plugs 52, 54 may have a frangible transverse bottom wall which will rupture at a predetermined pressure differential thereacross. In this way, pressure in the space 48 may be reduced to allow formation fluid pressure to rupture the plugs. Illustrations of both types of plugs 52 and 54 in a single basepipe 42 are exemplary, only. The entire mandrel or basepipe 42 may be provided with one or the other types of plugs and cooperating apertures in accordance with the present invention.

The sand control screen 34 also includes a generally tubular screen sleeve 62 which is fitted over the basepipe 42 and is suitably retained thereon by opposed collars 64 adjacent opposite ends of the basepipe, respectively. The sand control screen sleeve 62 may be formed of plural longitudinally and transversely extending wires 66, 68, 70 and 72, respectively, in accordance with known practices for manufacturing sand control screen sleeves. Alternatively, the sleeve 62 may be formed of a porous sintered metal, also in accordance with known techniques. The sleeve 62 may be mounted for relatively free rotation on the basepipe 42 between the collars 64 to allow the basepipe to rotate with the drillstring 24 and avoid damage to the screen 62 if it encounters the side wall of the wellbore 14. Suitable centralizers 74, FIG. 1, may also be interposed in the drillstring 24 to hold the sand control screen 34 out of contact with the wellbore wall. In order to minimize accumulation of solids particulates in the interstices formed between the screen wires of the screen sleeve 62, a fusible or meltable material such as paraffin wax 77 may be impregnated in accordance with the teaching of U.S. patent application Ser. No. 07/921,185. Providing the temporary plugs 52, 54 in the basepipe 42 and the temporarily-plugged screen sleeve 62 yields several advantages in installing sand control screens, particularly of the type which are interposed in a drillstring. The plugs 52 and 54 in the basepipe prevent short circuiting of the flow of drilling and motor activation fluid for the bit 26 and motor 28. The plugs 52 and 54 are of greater strength than a sacrificial foil wrapping around the exterior of the basepipe as would be required by the high pressures of the fluids being conducted through the drillstring. The use of the plugs 52 and 54 and the impregnated and temporarily-plugged screen 62 permits the wellbore to be drilled and cleaned using fluids having solids particulates entrained therein without risk of prematurely plugging the screen 34. The temporarily-plugged screen 34 also prevents the loss of large volumes of completion fluid into the formation and prevents plugging and clogging of the screen sleeve 62 from the inside during the drilling procedure.

The material selected for use in fabricating the plugs 52 and 54 is preferably one which will dissolve when contacted by a low pH acid or a high pH base solution. It is desirable, if metal is selected for the plug material, that it should be characterized by a relatively faster rate of etching or dissolution when contacted by an acid as compared to the rate that the basepipe is affected. Zinc, aluminum and magnesium are preferred materials. A suitable fluid for dissolving these materials may be hydrochloric or hydrofluoric acid or a strong basic solution of sodium hydroxide. Zinc is the preferred metal since it will exhibit the fastest dissolving rate in the above-mentioned acids. The plugs may also be made of a material such as a fiber reinforced paraffin wax which will dissolve in hydrocarbon fluids, for example.

The material 77 may be removed from the screen sleeve 62 by dissolving with a suitable solvent including crude oil and/or other hydrocarbons produced from the formation 11, by applying heat from the inside of the sand control screen 34 using heated fluid, a retrievable heater, not shown, or by other suitable means described in the aforementioned U.S. patent application Ser. No. 07/921,185.

Figure 4:
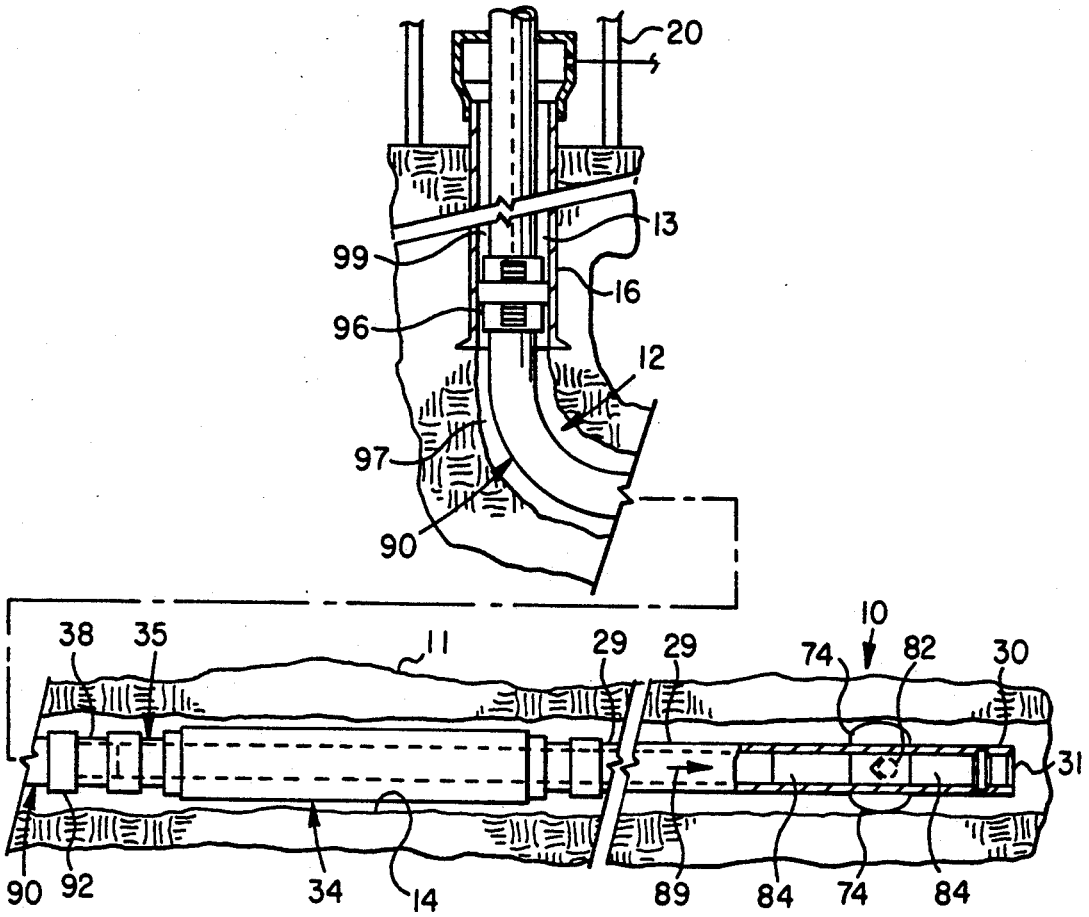
FIG. 4 is a view similar to FIG. 1 showing a part of the completion assembly for the well which includes the sand control screen of the present invention.
Figure 5:
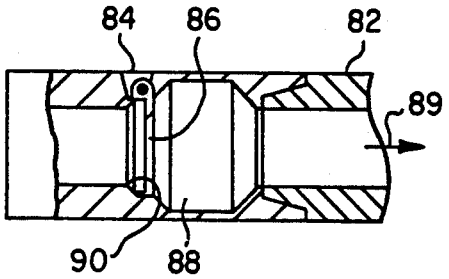
FIG. 5 is a detail view of a flapper type check valve which is placed in the completion assembly of the present invention.

Referring now to FIGS. 4 and 5, after the well 12 has been drilled to its predetermined depth or horizontal extension, the bit assembly 26 and its drive motor 28, if used, may be retrieved through the drillstring 24 using a wireline-conveyed retrieval mechanism or fishing tool or a tubing-conveyed retrieval mechanism, if desired. After retrieval of the bit assembly 26 and motor 28, a conventional ball type check valve sub 82, FIG. 4, and one or more flapper type check valve subs 84 are conveyed into and through the drillstring 24 and locked into the landing nipple 30, as illustrated. The flapper type check valve subs 84 may be of a type illustrated in FIG. 5, wherein a flapper type valve closure member 86 is pivotally supported on the sub 84 and disposed in a space 88 within the sub for engagement with a seat 90 to substantially prevent flow of fluid through the sub assembly comprising the subs 82 and 84 in a direction opposite to the arrow 89 in FIGS. 4 and 5. In other words, fluid flow is permitted through the drillstring 24 including the passage 48 in the screen 34 and the tailpipe section 29, including the landing nipple 30, in the direction of the arrow 89 but is substantially prevented from flow in the opposite direction. The closure members 86, which are pivotally mounted on the subs 84 for closure in the position shown in FIG. 5, may be formed of a porous material such as sintered metal which will permit some fluid flow in the direction opposite the arrow 89 but will substantially prevent any solids particulates from flowing through the tubing string or drillstring in the direction opposite the arrow 89. Alternatively, after drilling is completed and drilling fluid is circulated out of the wellbore, and circulation of any other fluids is completed, a suitable plug, not shown, may be installed in the open end of the nipple 30.

FIG. 4 also illustrates a replacement tubing string 90 in place in the well 12 and connected to the bottom hole assembly 35 which is characterized by the hook-up nipple 38, the screen 34 and the tailpipe section 29, including the landing nipple 30. The tubing string 90 includes a connecting member 92 which may have the same type of connecting or latching mechanism as the running tool 40, and which may be stabbed into and coupled to the hook-up nipple 38 to provide a continuous tubing string between the surface and the bottom hole assembly 35. The tubing string 90 also has interposed therein a conventional packer 96 which is settable to form a seal within the casing 16 in a conventional manner.

In completing a well such as the well 12 with the improved sand control screen and completion assembly of the present invention, unique methods are carried out. For example, the well 12 may be started by drilling in a conventional manner with a drillstring, not shown, which may be rotatable from the surface or may be non-rotatable and include the retrievable bit assembly 26 and drive motor 28. When the borehole of the well 12 reaches a formation zone which is relatively unstable or when the borehole is turned into the deviated or generally horizontal direction, the aforementioned drillstring is retrieved and the bottom hole assembly 35 is connected to the drillstring 24 and the wellbore is further drilled using the bit assembly 26 and drive motor 28, for example, to form the wellbore portion 14. Accordingly, the screen 34 is now in tow with the drillstring 24 as it progresses through the earth formation 10 to develop and form the wellbore portion 14. Once the wellbore portion 14 has been drilled to its prescribed depth or position, the bit assembly 26 and drive motor 28 are retrieved through the interior of the drillstring 24. Alternatively, if the drillstring 24 is of a type which is rotated, the bit may, if desired, be left connected to the distal end of the drillstring. In such an instance, the landing nipple 30 would be modified to provide two landing profiles so that the sub assembly comprising the subs 82 and 84 may be put in place within the tailpipe 29.

When it is desired to retrieve the portion of the drillstring 24 extending between the surface and the running tool 40, the running tool is disconnected from the hook-up nipple 38 and the drillstring is retrieved to the surface. The tubing string 90 is then assembled including its connector 92 and the packer 96 and is run in the well 12 and connected to the hook-up nipple 38. The packer 92 may be of a type which is either rotationally locked or hydraulically locked or set and this operation may be carried out after the tubing string 90 is connected to the bottom hole assembly 35 at the hook-up nipple 38. The packer 96 may be of a type which includes a bypass valve to permit flow of fluid, when desired, between annulus portion 97 below the packer 96 and annulus 99 in the wellbore portion 13.

When the tubing string 90 has been connected to the bottom hole assembly 35 and set in its working position in the well 12, drilling fluid which is present in the wellbore portion 14 may be circulated out by, for example, allowing the well to flow production fluid from the zone of interest 11 through the open distal end 31 of the landing nipple 30 and through the interior of the tailpipe section 29, the screen 34 and the tubing string 90 to the surface. In this way, drilling fluid and the particulate solids entrained therein may be "unloaded" from the wellbore portion 14. Alternatively, if the packer 96 has a bypass valve therein, the drilling fluid present in the wellbore portion 14 may be circulated out by pumping a completion fluid down through the tubing string 90 and out through the open end of the landing nipple 30 to circulate fluid out through the annulus 97 and the annulus 99. The flow direction of removal of drilling fluid may be reversed.

If the material 77 which has temporarily plugged the flow passages between the screen wires 66, 68, 70 and 72 is of a type which may be melted or dissolved by the formation fluids, the screen sleeve 62 may be flushed free of the plugging medium during circulation of drilling fluid out of the wellbore portion 14 as described above. Alternatively, once the drilling fluid has been evacuated from the wellbore portion 14, an acid or caustic solution may be circulated down through the tubing string 90, and the interior of the sand control screen 34 to begin dissolving the plugs 52 and 54. Once the plugs 52 and 54 are dissolved, the metal dissolving solution pumped through the passage 48 may be replaced by one which will dissolve the plugging medium 77. If the plugging medium is a low-viscosity hydrocarbon wax of the paraffin category such as a wax made by the Fischer-Tropsch process (commercially available from Moore & Munger Marketing, Inc., Shelton, Conn.), this wax material may be dissolved by solvents such as the formation fluids or benzene, naphtha, pentane, toluene or xylene which may be circulated down through the tubing string 90 and the screen 34.

If the temperature of the wellbore portion 14 is at or near the melting point of the wax plugging medium 77, then this material may be easily removed by melting or by differential pressure acting through the screen 62. The latter occurrence is more likely to be achieved after the assembly of the subs 82 and 84 is conveyed down through the tubing string 90 and locked into the tailpipe section 29 at the landing nipple 30. For example, the pressure of the fluid in the tubing string 90 may be lowered by pumping "down" the interior of the tubing string at the surface or displacing fluid in the passage 48 and the tubing string by injecting nitrogen gas, foam, or a less dense liquid, through a coiled tubing string inserted in the tubing string 90 to create a differential pressure across the screen sleeve 62. Under such a condition, formation fluids will force the plugging medium 77 to flow through the apertures 50 and into the passage 48, together with these fluids. The check valves formed by the closure members 86 and the check valve in the sub 82 will prevent flow of fluid through the open end 31 and the interior of the tailpipe section 29. However, if the check valve in the sub 82 should fail, at least one of the valve closure members 86 is likely to prevent the flow of solids through the open end 31 but will permit some flow of fluid which has been filtered, thanks to the permeable material of which the closure members 86 have been fabricated.

Figure 6:
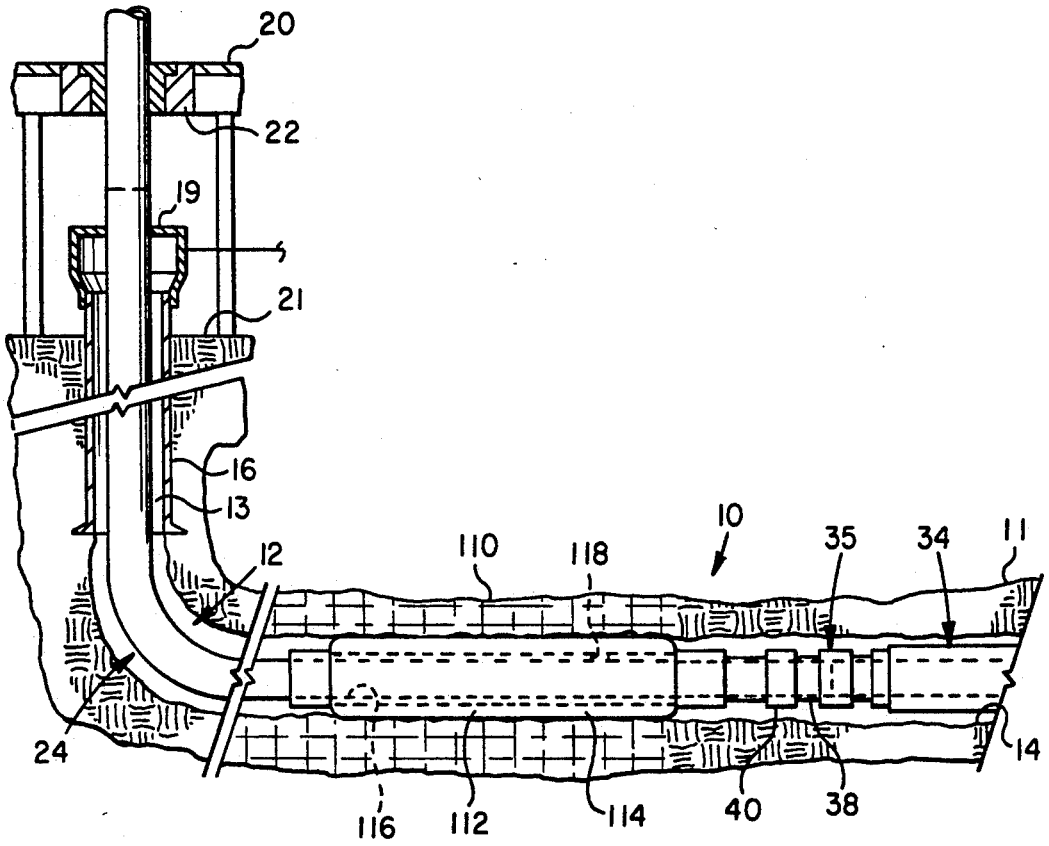
FIG. 6 is a view similar to FIG. 1 showing an inflatable seal member interposed in the drillstring.

Referring now to FIG. 6, there is illustrated a situation wherein the earth formation 10 has a portion 110 which may comprise a shale body which is likely to slough profusely into the wellbore 14. In order to prevent such action and the eventual clogging of the screen 34, which would result, the drillstring 24 has interposed therein an inflatable seal member 112 which is operable to receive pressure fluid from the drillstring to inflate or distend a resilient bladder-like element 114 into forcible engagement with the wellbore wall to prevent cave-in or sloughing of the shale material from the zone or portion 110 into the wellbore. The inflatable seal member 112 may receive pressure fluid from within the drillstring through a central passage 116 and a branch passage 118 to cause the inflatable or distendable element 114 to engage the wellbore wall and form a substantially fluid tight seal. In this latter event the seal member 112 may also then serve as a plug to allow certain cementing operations to be carried out between the seal member 112 and the surface 21.

Suitable control valve means, not shown, which may be electrically or hydraulically actuated, may be operable to effect inflation and deflation of the seal element 114 when desired. In the illustration of FIG. 6, the seal member 112 is interposed in the drillstring 24 "uphole" of the running tool or coupling portion 40. In this regard, the seal member 112 may be installed after completion of drilling and withdrawal of the portion of the drillstem 24 uphole of the hook-up nipple 38. The seal member 112 could then be connected to a running tool 40 and a tubing string replacing the drillstring 24, run into the wellbore 14 and coupled to the hook-up nipple 38. In this way, once the well is to be brought into production, cave-in or sloughing off of the shale material from the zone 110 will be minimized.

The components of the drillstring 24, tubing string 90, the sand control screen 34, the hook-up nipple 38, the running tool or couplings 40 and 92, seal member 112 and certain of the other components described may be fabricated using conventional engineering materials known to those skilled in the art of wellbore tools and structures for oil and gas wells, in particular. The basepipe 42 of the screen 34, as well as the screen wires 66, 68, 70 and 72, should be formed of a material which is much less active than the material of the sacrificial plugs 52 and 54, as will be appreciated by those skilled in the art. Moreover, the method of the invention may be carried out on generally vertical wells even though it is particularly advantageous for deviated and generally horizontal wells. Although preferred embodiments of a sand control screen, completion assembly and method have been described in detail hereinabove, those skilled in the art will recognize that various substitutions and modifications may be made to the invention without departing from the scope and spirit of the appended claims.

What is claimed is:

1. A method of installing a sand control screen in a wellbore, comprising the steps of:

providing a drillstring comprising a distal end section and drill bit means suitably connected thereto, a sand control screen interposed in said drillstring between said distal end section and a portion of said drillstring extending toward the surface;

drilling at least a portion of said wellbore with said drillstring including said sand control screen interposed therein and including pumping of drilling fluid through said drillstring and an interior passage of said sand control screen to remove drill cuttings from said well; and after drilling said well, producing fluids through said sand control screen without removing said sand control screen and said distal section of said drillstring from said wellbore prior to said producing of said fluids.

2. The method set forth in claim 1 including the step of:

providing said sand control screen with a temporary plugging medium to prevent plugging of said sand control screen with solids entrained in said drilling fluid during drilling of said well; and removing said temporary plugging medium from said sand control screen.

3. The method set forth in claim 2 wherein:

said sand control screen includes a basepipe including a plurality of apertures formed therein and said temporary plugging medium comprises plug means interposed in said apertures, respectively; and the step of removing said temporary plugging medium comprises injecting a fluid into said sand control screen to dissolve said plug means, respectively.

4. The method set forth in claim 2 wherein:

said sand control screen includes a screen sleeve having a temporary plugging medium occupying the interstices formed in said screen sleeve; and the step of removing said temporary plugging medium comprises causing said temporary plugging medium to go into a fluid state and to flow out of said interstices.

5. The method set forth in claim 1 including the step of:

disconnecting a part of said drillstring from a bottom hole assembly comprising said sand control screen and said distal section of said drillstring;

removing said part of said drillstring from said wellbore; and inserting a tubing string into said wellbore including seal means interposed therein for sealing one portion of said wellbore from another and connecting said tubing string to said bottom hole assembly.

6. The method set forth in claim 1 including the step of:

retrieving said bit means through the interior of said drillstring.

7. The method set forth in claim 1 including the step of:

inserting a sub into said drillstring and connected to said distal end section, said sub including means therein to prevent flow of fluid from said wellbore through said distal end section to the interior of said sand control screen.

8. The method set forth in claim 7 wherein:

said means to prevent flow of fluid comprises one-way valve means.

9. The method set forth in claim 1 including the step of:

sealing a portion of said wellbore with inflatable seal means interposed in said drillstring.

* * * * *